US010451257B2

(12) United States Patent
Cok

(10) Patent No.: US 10,451,257 B2
(45) **Date of Patent: *Oct. 22, 2019**

(54) MICRO-LIGHT-EMITTING DIODE BACKLIGHT SYSTEM

(71) Applicant: X-Celeprint Limited, Cork (IE)

(72) Inventor: Ronald S. Cok, Rochester, NY (US)

(73) Assignee: X-Celeprint Limited, Cork (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/054,830

(22) Filed: Aug. 3, 2018

(65) Prior Publication Data

US 2018/0340681 A1 Nov. 29, 2018

Related U.S. Application Data

(63) Continuation of application No. 14/963,813, filed on Dec. 9, 2015, now Pat. No. 10,066,819.

(51) Int. Cl.
*F21V 23/00* (2015.01)
*G09G 3/22* (2006.01)
(Continued)

(52) U.S. Cl.
CPC ..... *F21V 23/003* (2013.01); *F21V 19/0025* (2013.01); *F21V 23/001* (2013.01);
(Continued)

(58) Field of Classification Search
CPC ..... G09G 3/3406; G09G 2320/0646; G09G 2360/16; G09G 2330/021; G09G 2320/064; G09G 3/22
See application file for complete search history.

(56) References Cited

U.S. PATENT DOCUMENTS 4,746,202 A 5/1988 Perilloux et al.
5,060,027 A 10/1991 Hart et al.
(Continued)

FOREIGN PATENT DOCUMENTS

CN 103677427 A 3/2014
EP 1662301 A1 5/2006
(Continued)

OTHER PUBLICATIONS

Bower, C. A. et al., Micro-Transfer-Printing: Heterogeneous Integration of Microscale Semiconductor Devices using Elastomer Stamps, 2014 IEEE Sensors, 3 pages and 1 page IEEE Xplore abstract, date of conference: Nov. 2-5, 2014.
(Continued)

*Primary Examiner* — Md Saiful A Siddiqui
(74) *Attorney, Agent, or Firm* — William R. Haulbrook; Michael D. Schmitt; Choate, Hall & Stewart LLP

(57) ABSTRACT

A backlight system includes a backplane and a plurality of bare die light emitters disposed on the backplane. Each light emitter has a light-emitter substrate and contact pads on the light-emitter substrate through which electrical current is supplied to cause the light emitter to emit light. A plurality of first and second backplane conductors are disposed on the backplane for conducting control signals to control the light emitters through the contact pads. A plurality of light valves is disposed to receive light from the light emitters. The number of light valves is greater than the number of light emitters.

22 Claims, 10 Drawing Sheets

(51) Int. Cl.

| | |
|---|---|
| ***F21V 19/00*** | (2006.01) |
| ***H05B 33/08*** | (2006.01) |
| ***G09G 3/34*** | (2006.01) |
| *F21Y 115/10* | (2016.01) |
| *F21Y 113/10* | (2016.01) |

(52) U.S. Cl.

CPC ..... *G09G 3/22* (2013.01); *G09G 3/3426* (2013.01); *H05B 33/0821* (2013.01); *H05B 33/0845* (2013.01); *H05B 33/0857* (2013.01); *F21Y 2113/10* (2016.08); *F21Y 2115/10* (2016.08); *G09G 2360/16* (2013.01)

(56) References Cited

U.S. PATENT DOCUMENTS 5,550,066 A 8/1996 Tang et al.
5,621,555 A 4/1997 Park
5,625,202 A 4/1997 Chai
5,748,161 A 5/1998 Lebby et al.
5,815,303 A 9/1998 Berlin
5,886,401 A 3/1999 Liu
5,994,722 A 11/1999 Averbeck et al.
6,025,730 A 2/2000 Akram et al.
6,084,579 A 7/2000 Hirano
6,087,680 A 7/2000 Gramann et al.
6,142,358 A 11/2000 Cohn et al.
6,143,672 A 11/2000 Ngo et al.
6,169,294 B1 1/2001 Biing-Jye et al.
6,184,477 B1 2/2001 Tanahashi
6,278,242 B1 8/2001 Cok et al.
6,288,824 B1 9/2001 Kastalsky
6,340,999 B1 1/2002 Masuda et al.
6,392,340 B2 5/2002 Yoneda et al.
6,403,985 B1 6/2002 Fan et al.
6,410,942 B1 6/2002 Thibeault et al.
6,466,281 B1 10/2002 Huang et al.
6,504,180 B1 1/2003 Heremans et al.
6,577,367 B2 6/2003 Kim
6,650,382 B1 11/2003 Sumida et al.
6,660,457 B1 12/2003 Imai et al.
6,703,780 B2 3/2004 Shiang et al.
6,717,560 B2 4/2004 Cok et al.
6,756,576 B1 6/2004 McElroy et al.
6,812,637 B2 11/2004 Cok et al.
6,825,559 B2 11/2004 Mishra et al.
6,828,724 B2 12/2004 Burroughes
6,881,946 B2 4/2005 Cok et al.
6,933,532 B2 8/2005 Arnold et al.
6,969,624 B2 11/2005 Iwafuchi et al.
6,975,369 B1 12/2005 Burkholder
7,009,220 B2 3/2006 Oohata
7,012,382 B2 3/2006 Cheang et al.
7,091,523 B2 8/2006 Cok et al.
7,098,589 B2 8/2006 Erchak et al.
7,127,810 B2 10/2006 Kasuga et al.
7,129,457 B2 10/2006 McElroy et al.
7,157,838 B2 1/2007 Thielemans et al.
7,195,733 B2 3/2007 Rogers et al.
7,259,391 B2 8/2007 Liu et al.
7,288,753 B2 10/2007 Cok
7,394,194 B2 7/2008 Cok
7,402,951 B2 7/2008 Cok
7,408,296 B2 8/2008 Cok et al.
7,417,648 B2 8/2008 Credelle
7,420,221 B2 9/2008 Nagai
7,466,075 B2 12/2008 Cok et al.
7,521,292 B2 4/2009 Rogers et al.
7,557,367 B2 7/2009 Rogers et al.
7,586,497 B2 9/2009 Boroson et al.
7,605,053 B2 10/2009 Couillard et al.
7,614,757 B2 11/2009 Nesterenko et al.
7,622,367 B1 11/2009 Nuzzo et al.
7,629,955 B2 12/2009 Asao et al.
7,662,545 B2 2/2010 Nuzzo et al.
7,687,812 B2 3/2010 Louwsma et al.
7,704,684 B2 4/2010 Rogers et al.
7,791,271 B2 9/2010 Cok et al.
7,799,699 B2 9/2010 Nuzzo et al.
7,816,856 B2 10/2010 Cok et al.
7,834,541 B2 11/2010 Cok
7,872,722 B2 1/2011 Kimura
7,893,612 B2 2/2011 Cok
7,898,734 B2 3/2011 Coleman et al.
7,919,342 B2 4/2011 Cok
7,927,976 B2 4/2011 Menard
7,932,123 B2 4/2011 Rogers et al.
7,943,491 B2 5/2011 Nuzzo et al.
7,948,172 B2 5/2011 Cok et al.
7,969,085 B2 6/2011 Cok
7,972,875 B2 7/2011 Rogers et al.
7,982,296 B2 7/2011 Nuzzo et al.
7,990,058 B2 8/2011 Cok et al.
7,999,454 B2 8/2011 Winters et al.
8,004,758 B2 8/2011 Coleman et al.
8,029,139 B2 10/2011 Ellinger et al.
8,039,847 B2 10/2011 Nuzzo et al.
8,058,663 B2 11/2011 Fan et al.
8,198,621 B2 6/2012 Rogers et al.
8,207,547 B2 6/2012 Lin
8,243,027 B2 8/2012 Hotelling et al.
8,261,660 B2 9/2012 Menard
8,288,843 B2 10/2012 Kojima et al.
8,334,545 B2 12/2012 Levermore et al.
8,394,706 B2 3/2013 Nuzzo et al.
8,440,546 B2 5/2013 Nuzzo et al.
8,450,927 B2 5/2013 Lenk et al.
8,470,701 B2 6/2013 Rogers et al.
8,502,192 B2 8/2013 Kwak et al.
8,506,867 B2 8/2013 Menard
8,536,584 B2 9/2013 Yao
8,581,827 B2 11/2013 Park et al.
8,596,846 B2 12/2013 Yankov et al.
8,599,118 B2 12/2013 Cok
8,619,011 B2 12/2013 Kimura
8,664,699 B2 3/2014 Nuzzo et al.
8,686,447 B2 4/2014 Tomoda et al.
8,722,458 B2 5/2014 Rogers et al.
8,735,932 B2 5/2014 Kim et al.
8,754,396 B2 6/2014 Rogers et al.
8,766,970 B2 7/2014 Chien et al.
8,791,474 B1 7/2014 Bibl et al.
8,794,501 B2 8/2014 Bibl et al.
8,803,857 B2 8/2014 Cok
8,817,369 B2 8/2014 Daiku
8,829,663 B2 9/2014 Pohl et al.
8,835,940 B2 9/2014 Hu et al.
8,836,624 B2 9/2014 Roberts et al.
8,854,294 B2 10/2014 Sakariya
8,860,051 B2 10/2014 Fellows et al.
8,877,648 B2 11/2014 Bower et al.
8,884,844 B2 11/2014 Yang et al.
8,889,485 B2 11/2014 Bower
8,895,406 B2 11/2014 Rogers et al.
8,896,505 B2 11/2014 Cok et al.
8,901,578 B2 12/2014 Kobayakawa et al.
8,902,152 B2 12/2014 Bai et al.
8,912,020 B2 12/2014 Bedell et al.
8,946,760 B2 2/2015 Kim
8,987,765 B2 3/2015 Bibl et al.
9,022,632 B2 5/2015 Kim et al.
9,048,449 B2 6/2015 Kim et al.
9,105,714 B2 8/2015 Hu et al.
9,105,813 B1 8/2015 Chang
9,153,171 B2 10/2015 Sakariya et al.
9,161,448 B2 10/2015 Menard et al.
9,178,123 B2 11/2015 Sakariya et al.
9,202,996 B2 12/2015 Orsley et al.
9,226,361 B2 12/2015 Toth
9,277,618 B2 3/2016 Odnoblyudov et al.
9,293,422 B1 3/2016 Parsa et al.
9,308,649 B2 4/2016 Golda et al.
9,329,430 B2 5/2016 Erinjippurath et al.
9,343,042 B2 5/2016 Miller et al.

(56) References Cited

U.S. PATENT DOCUMENTS 9,358,775 B2 6/2016 Bower et al.
9,362,348 B2 6/2016 Lowenthal et al.
9,368,683 B1 6/2016 Meitl et al.
9,412,977 B2 8/2016 Rohatgi
9,437,782 B2 9/2016 Bower et al.
9,444,015 B2 9/2016 Bower et al.
9,478,583 B2 10/2016 Hu et al.
9,520,537 B2 12/2016 Bower et al.
9,537,069 B1 1/2017 Bower et al.
9,590,025 B2 3/2017 Yu et al.
9,601,356 B2 3/2017 Bower et al.
9,626,908 B2 4/2017 Sakariya et al.
9,640,715 B2 5/2017 Bower et al.
9,698,308 B2 7/2017 Bower et al.
9,705,042 B2 7/2017 Bower et al.
9,716,082 B2 7/2017 Bower et al.
9,741,785 B2 8/2017 Bower et al.
9,761,754 B2 9/2017 Bower et al.
9,765,934 B2 9/2017 Rogers et al.
9,847,047 B2 12/2017 Wu et al.
9,860,955 B2 1/2018 Kim et al.
9,865,832 B2 1/2018 Bibl et al.
9,871,345 B2 1/2018 Bower et al.
9,929,053 B2 3/2018 Bower et al.
9,991,163 B2 6/2018 Bower et al.
10,066,819 B2 9/2018 Cok
10,078,239 B2 9/2018 Sugita et al.
10,103,069 B2 10/2018 Bower et al.
10,209,813 B2 2/2019 Yao et al.
10,224,460 B2 3/2019 Bower et al.
2001/0022564 A1 9/2001 Youngquist et al.
2002/0084952 A1 7/2002 Morley et al.
2002/0096994 A1 7/2002 Iwafuchi et al.
2002/0118321 A1 8/2002 Ge
2003/0117369 A1 6/2003 Spitzer et al.
2004/0080483 A1 4/2004 Chosa
2004/0080941 A1 4/2004 Jiang et al.
2004/0180476 A1 9/2004 Kazlas et al.
2004/0212296 A1 10/2004 Nakamura et al.
2004/0227704 A1 11/2004 Wang et al.
2004/0252933 A1 12/2004 Sylvester et al.
2005/0006657 A1 1/2005 Terashita
2005/0012076 A1 1/2005 Morioka
2005/0116621 A1 6/2005 Bellmann et al.
2005/0140275 A1 6/2005 Park
2005/0168987 A1 8/2005 Tamaoki et al.
2005/0202595 A1 9/2005 Yonehara et al.
2005/0264472 A1 12/2005 Rast
2005/0275615 A1 12/2005 Kahen et al.
2005/0285246 A1 12/2005 Haba et al.
2006/0051900 A1 3/2006 Shizuno
2006/0063309 A1 3/2006 Sugiyama et al.
2006/0132671 A1 6/2006 Koma
2006/0180818 A1 8/2006 Nagai et al.
2006/0246811 A1 11/2006 Winters et al.
2006/0273862 A1* 12/2006 Shimmura ..... H01L 21/2026 333/24.1
2006/0289972 A1 12/2006 Nishimura et al.
2007/0035340 A1 2/2007 Kimura
2007/0077349 A1 4/2007 Newman et al.
2007/0182809 A1 8/2007 Yarid et al.
2007/0201056 A1 8/2007 Cok et al.
2008/0108171 A1 5/2008 Rogers et al.
2008/0211734 A1 9/2008 Huitema et al.
2008/0296717 A1 12/2008 Beroz et al.
2009/0045420 A1 2/2009 Eng et al.
2009/0140630 A1 6/2009 Kijima et al.
2009/0146921 A1 6/2009 Takahashi
2009/0278142 A1 11/2009 Watanabe et al.
2009/0295706 A1* 12/2009 Feng ..... G09G 3/342 345/102
2009/0315054 A1 12/2009 Kim et al.
2010/0038655 A1 2/2010 Chen et al.
2010/0060553 A1 3/2010 Zimmerman et al.
2010/0078670 A1 4/2010 Kim et al.
2010/0123134 A1 5/2010 Nagata
2010/0123268 A1 5/2010 Menard
2010/0148198 A1 6/2010 Sugizaki et al.
2010/0149117 A1 6/2010 Chien et al.
2010/0186883 A1 7/2010 Tomoda
2010/0190293 A1 7/2010 Maeda et al.
2010/0201253 A1 8/2010 Cok et al.
2010/0207852 A1 8/2010 Cok
2010/0214245 A1 8/2010 Hirota
2010/0214247 A1 8/2010 Tang et al.
2010/0248484 A1 9/2010 Bower et al.
2010/0258710 A1 10/2010 Wiese et al.
2010/0270912 A1 10/2010 Ko
2010/0289115 A1 11/2010 Akiyama et al.
2010/0317132 A1 12/2010 Rogers et al.
2010/0321414 A1 12/2010 Muroi et al.
2010/0328268 A1 12/2010 Teranishi et al.
2011/0032277 A1 2/2011 Lee et al.
2011/0043435 A1 2/2011 Hebenstreit et al.
2011/0069013 A1 3/2011 Rabenstein et al.
2011/0108800 A1 5/2011 Pan
2011/0120678 A1* 5/2011 Palm ..... F28D 9/0075 165/109.1
2011/0205448 A1* 8/2011 Takata ..... G02B 6/0055 348/739
2011/0211348 A1 9/2011 Kim
2011/0242027 A1 10/2011 Chang
2012/0018745 A1 1/2012 Liu et al.
2012/0049222 A1 3/2012 Yoshizumi et al.
2012/0056835 A1 3/2012 Choo et al.
2012/0062135 A1 3/2012 Tamaki et al.
2012/0105518 A1* 5/2012 Kang ..... G09G 3/3426 345/694
2012/0119249 A1 5/2012 Kim et al.
2012/0126229 A1* 5/2012 Bower ..... H01L 21/6835 257/48
2012/0141799 A1 6/2012 Kub et al.
2012/0193652 A1 8/2012 Horng et al.
2012/0206428 A1 8/2012 Cok
2012/0206499 A1 8/2012 Cok
2012/0212465 A1 8/2012 White et al.
2012/0223636 A1 9/2012 Shin et al.
2012/0223875 A1 9/2012 Lau et al.
2012/0228669 A1 9/2012 Bower et al.
2012/0236022 A1 9/2012 Homma et al.
2012/0256163 A1 10/2012 Yoon et al.
2012/0274669 A1 11/2012 Neal
2012/0281028 A1* 11/2012 Orlick ..... G09G 3/3426 345/690
2012/0314388 A1 12/2012 Bower et al.
2012/0320566 A1 12/2012 Namekata
2013/0006524 A1* 1/2013 Sasaki ..... G01C 21/367 701/430
2013/0010405 A1 1/2013 Rothkopf et al.
2013/0015483 A1 1/2013 Shimokawa et al.
2013/0016494 A1 1/2013 Speier et al.
2013/0036928 A1 2/2013 Rogers et al.
2013/0069275 A1 3/2013 Menard et al.
2013/0088416 A1 4/2013 Smith et al.
2013/0128585 A1 5/2013 Bibl et al.
2013/0161667 A1 6/2013 Chen et al.
2013/0196474 A1 8/2013 Meitl et al.
2013/0207964 A1 8/2013 Fleck et al.
2013/0221355 A1 8/2013 Bower et al.
2013/0248889 A1* 9/2013 Lin ..... H01L 25/0753 257/88
2013/0257264 A1 10/2013 Tamaki et al.
2013/0273695 A1 10/2013 Menard et al.
2013/0278513 A1 10/2013 Jang
2013/0309792 A1 11/2013 Tischler et al.
2014/0014960 A1 1/2014 Yamazaki et al.
2014/0027709 A1 1/2014 Higginson et al.
2014/0082934 A1 3/2014 Cok
2014/0084482 A1 3/2014 Hu et al.
2014/0085214 A1 3/2014 Cok
2014/0094878 A1 4/2014 Gossler et al.
2014/0104157 A1 4/2014 Burns et al.
2014/0104243 A1 4/2014 Sakariya et al.
2014/0111442 A1 4/2014 Cok et al.

(56) References Cited

U.S. PATENT DOCUMENTS

2014/0146273 A1 5/2014 Kim et al.
2014/0159043 A1 6/2014 Sakariya et al.
2014/0159065 A1 6/2014 Hu et al.
2014/0175498 A1 6/2014 Lai
2014/0183446 A1 7/2014 Nago et al.
2014/0192079 A1 7/2014 Lee et al.
2014/0197509 A1 7/2014 Haddad et al.
2014/0198373 A1 7/2014 Ray
2014/0217448 A1 8/2014 Kim et al.
2014/0225938 A1 8/2014 Soni et al.
2014/0231839 A1 8/2014 Jeon et al.
2014/0231851 A1 8/2014 Tsai et al.
2014/0240617 A1 8/2014 Fukutome et al.
2014/0264763 A1 9/2014 Meitl et al.
2014/0267683 A1 9/2014 Bibl et al.
2014/0306248 A1 10/2014 Ahn et al.
2014/0319486 A1 10/2014 Hong
2014/0339495 A1 11/2014 Bibl et al.
2014/0340900 A1 11/2014 Bathurst et al.
2014/0367633 A1 12/2014 Bibl et al.
2014/0367705 A1 12/2014 Bibl et al.
2015/0003040 A1 1/2015 Bessho et al.
2015/0015517 A1 1/2015 Zhao
2015/0021632 A1* 1/2015 Taghizadeh ..... F21K 9/00 257/88
2015/0084054 A1 3/2015 Fan et al.
2015/0135525 A1 5/2015 Bower
2015/0137153 A1 5/2015 Bibl et al.
2015/0169011 A1 6/2015 Bibl et al.
2015/0170602 A1 6/2015 Kang
2015/0179453 A1 6/2015 Cheng et al.
2015/0255438 A1 9/2015 Oraw et al.
2015/0263066 A1 9/2015 Hu et al.
2015/0263256 A1 9/2015 Hsieh et al.
2015/0279822 A1 10/2015 Hsu
2015/0280066 A1 10/2015 Fujimura et al.
2015/0280089 A1 10/2015 Obata et al.
2015/0296580 A1* 10/2015 Kim ..... G02F 1/133603 349/69
2015/0308634 A1 10/2015 van de Ven et al.
2015/0327388 A1 11/2015 Menard et al.
2015/0362165 A1 12/2015 Chu et al.
2015/0370130 A1* 12/2015 Lin ..... G02F 1/133603 349/69
2015/0371585 A1 12/2015 Bower et al.
2015/0371974 A1 12/2015 Bower et al.
2015/0372051 A1 12/2015 Bower et al.
2015/0372052 A1 12/2015 Bower et al.
2015/0372053 A1 12/2015 Bower et al.
2015/0372187 A1 12/2015 Bower et al.
2015/0373793 A1 12/2015 Bower et al.
2016/0004123 A1 1/2016 Tanabe
2016/0005721 A1 1/2016 Bower et al.
2016/0018094 A1 1/2016 Bower et al.
2016/0056725 A1 2/2016 Kim et al.
2016/0057822 A1 2/2016 Chu
2016/0057827 A1 2/2016 Miskin
2016/0057832 A1 2/2016 Briggs et al.
2016/0064363 A1 3/2016 Bower et al.
2016/0085120 A1 3/2016 Xu
2016/0093600 A1 3/2016 Bower et al.
2016/0103547 A1 4/2016 Lu et al.
2016/0131329 A1 5/2016 Park et al.
2016/0210895 A1 7/2016 Fan et al.
2016/0211245 A1 7/2016 Do
2016/0260388 A1 9/2016 Yata et al.
2016/0266697 A1 9/2016 Cheng et al.
2016/0343772 A1 11/2016 Bower et al.
2016/0351539 A1 12/2016 Bower et al.
2016/0364030 A1 12/2016 Peana et al.
2016/0370855 A1 12/2016 Lanier et al.
2017/0005244 A1 1/2017 Bower et al.
2017/0010706 A1 1/2017 Cok
2017/0025075 A1 1/2017 Cok et al.
2017/0025395 A1 1/2017 Chen et al.
2017/0025484 A1 1/2017 Forrest et al.
2017/0047393 A1 2/2017 Bower et al.
2017/0048976 A1 2/2017 Prevatte et al.
2017/0061842 A1 3/2017 Cok et al.
2017/0068362 A1 3/2017 Den Boer et al.
2017/0092863 A1 3/2017 Bower et al.
2017/0102797 A1 4/2017 Cok
2017/0122502 A1 5/2017 Cok et al.
2017/0133818 A1 5/2017 Cok
2017/0148771 A1 5/2017 Cha et al.
2017/0186740 A1 6/2017 Cok et al.
2017/0187976 A1 6/2017 Cok
2017/0206845 A1 7/2017 Sakariya et al.
2017/0221266 A1 8/2017 Schubert et al.
2017/0250167 A1 8/2017 Bower et al.
2017/0250219 A1 8/2017 Bower et al.
2017/0256521 A1 9/2017 Cok et al.
2017/0256522 A1 9/2017 Cok et al.
2017/0287882 A1 10/2017 Cok et al.
2017/0338374 A1 11/2017 Zou et al.
2017/0352646 A1 12/2017 Bower et al.
2017/0352647 A1 12/2017 Raymond et al.
2017/0357127 A1 12/2017 Cok et al.
2017/0358717 A1 12/2017 Cok et al.
2018/0007750 A1 1/2018 Meitl et al.
2018/0033853 A1 2/2018 Bower et al.
2018/0041005 A1 2/2018 Bower et al.
2018/0084614 A1 3/2018 Bower et al.
2018/0174932 A1 6/2018 Cok et al.
2018/0175248 A1 6/2018 Ahmed
2018/0197471 A1 7/2018 Rotzoll et al.
2018/0226386 A1 8/2018 Cok
2018/0277525 A1 9/2018 Cok et al.
2018/0323180 A1 11/2018 Cok
2018/0366450 A1 12/2018 Gardner et al.
2019/0027534 A1 1/2019 Rotzoll et al.
2019/0088630 A1 3/2019 Cok et al.

FOREIGN PATENT DOCUMENTS

EP 2078978 A2 7/2009
EP 2148264 A2 1/2010
EP 2 610 314 A1 7/2013
EP 2703969 A2 3/2014
JP 11-142878 5/1999
JP 2010-103186 A 5/2010
JP 2013-221965 A 10/2013
WO WO-2006/027730 A1 3/2006
WO WO-2006/099741 A1 9/2006
WO WO-2008/103931 A2 8/2008
WO WO-2010/032603 A1 3/2010
WO WO-2010/132552 A1 11/2010
WO WO-2013/011415 A1 1/2013
WO WO-2013/064800 A1 5/2013
WO WO-2014/121635 A1 8/2014
WO WO-2014/149864 A1 9/2014
WO WO-2015/088629 A1 6/2015
WO WO-2015/193434 A2 12/2015
WO WO-2016/030422 A1 3/2016
WO WO-2016/046283 A2 3/2016
WO WO-2017/042252 A1 3/2017
WO WO-2017/060487 A2 4/2017
WO WO-2017/149067 A1 9/2017
WO WO-2017/174632 A1 10/2017

OTHER PUBLICATIONS

Bower, C. A. et al., Transfer Printing: An Approach for Massively Parallel Assembly of Microscale Devices, IEEE, Electronic Components and Technology Conference, (2008).

Cok, R. S. et al., 60.3: AMOLED Displays Using Transfer-Printed Integrated Circuits, Society for Information Display, 10:902-904, (2010).

Feng, X. et al., Competing Fracture in Kinetically Controlled Transfer Printing, Langmuir, 23(25):12555-12560, (2007).

Gent, A.N., Adhesion and Strength of Viscoelastic Solids. Is There a Relationship between Adhesion and Bulk Properties?, American Chemical Society, Langmuir, 12(19):4492-4496, (1996).

(56) References Cited

OTHER PUBLICATIONS

Kim, Dae-Hyeong et al., Optimized Structural Designs for Stretchable Silicon Integrated Circuits, Small, 5(24):2841-2847, (2009).
Kim, Dae-Hyeong et al., Stretchable and Foldable Silicon Integrated Circuits, Science, 320:507-511, (2008).
Kim, S. et al., Microstructured elastomeric surfaces with reversible adhesion and examples of their use in deterministic assembly by transfer printing, PNAS, 107(40):17095-17100 (2010).
Kim, T. et al., Kinetically controlled, adhesiveless transfer printing using microstructured stamps, Applied Physics Letters, 94(11):113502-1-113502-3, (2009).
Meitl, M. A. et al., Transfer printing by kinetic control of adhesion to an elastomeric stamp, Nature Material, 5:33-38, (2006).
Michel, B. et al., Printing meets lithography: Soft approaches to high-resolution patterning, J. Res. & Dev. 45(5):697-708, (2001).
Trindade, A.J. et al., Precision transfer printing of ultra-thin AlInGaN micron-size light-emitting diodes, Crown, pp. 217-218, (2012).
Choi, H. W. et al., Efficient GaN-based Micro-LED Arrays, Mat. Res. Soc. Symp. Proc. 743:L6.28.1-L6.28.6 (2003).
Cok, R. S. et al., AMOLED displays with transfer-printed integrated circuits, Journal of SID, 19(4):335-341 (2011).
Hamer et al., 63.2: AMOLED Displays Using Transfer-Printed Integrated Circuits, SID 09 Digest, 40(2):947-950 (2009).
Johnson, K. et al., Advances in Red VCSEL Technology, Advances in Optical Technologies, 2012:569379, 13 pages (2012).
Kasahara, D. et al, Nichia reports first room-temperature blue/'green' VCSELs with current injection, Appl. Phys. Express, 4(7):3 pages (2011).
Koma, N. et al., 44.2: Novel Front-light System Using Fine-pitch Patterned OLED, SID, 08:655-658 (2008).
Lee, S. H. etal, Laser Lift-Offof GaN Thin Film and its Application to the Flexible Light Emitting Diodes, Proc. of SPIE 8460:846011-1-846011-6 (2012).
Matioli, E. et al., High-brightness polarized light-emitting diodes, Light: Science & Applications, 1:e22:1-7 (2012).
Poher, V. et al., Micro-LED arrays: a tool for two-dimensional neuron stimulation, J. Phys. D: Appl. Phys. 41:094014 (2008).
Roscher, H., VCSEL Arrays with Redundant Pixel Designs for 10Gbits/s 2-D Space-Parallel MMF Transmission, Annual Report, optoelectronics Department, (2005).
Seurin, J.F. et al, High-power red VCSEL arrays, Proc. of SPIE 8639:1-9 (2013).
Yaniv et al., A 640 × 480 Pixel Computer Display Using Pin Diodes with Device Redundancy, 1988 International Display Research Conference, IEEE, CH-2678-1/88:152-154 (1988).
Yoon, J. et al., Heterogeneously Integrated Optoelectronic Devices Enabled by MicroTransfer Printing, Adv. Optical Mater. 3:1313-1335 (2015).

* cited by examiner

MICRO-LIGHT-EMITTING DIODE BACKLIGHT SYSTEM

PRIORITY APPLICATION

This application is a continuation of U.S. patent application Ser. No. 14/963,813, filed Dec. 9, 2015, entitled Micro-Light-Emitting Diode Backlight System.

FIELD OF THE INVENTION

The present invention relates to display backlights and, more particularly, to direct-view display backlights incorporating light-emitting diodes.

BACKGROUND OF THE INVENTION

Flat-panel displays are widely used in conjunction with computing devices, in portable devices, and for entertainment devices such as televisions. Such displays typically employ a plurality of pixels distributed over a display substrate to display images, graphics, or text. For example, liquid crystal displays (LCDs) employ liquid crystals to block or transmit light from a backlight behind the liquid crystals and organic light-emitting diode (OLED) displays rely on passing current through a layer of organic material that glows in response to the electrical current. Inorganic light-emitting diodes (LEDs) are also used in displays.

Backlight systems can take a variety of forms. Direct-view backlights employ an array of light emitters located in layer behind a layer of light valves, such as liquid crystals. Edge-lit backlights employ an array of light emitters located around the periphery of a backlight. In either case, light diffusers are located between the light emitters and the light valves and other functional layers can provide functions such as light recycling, brightness enhancement, and polarization.

Originally, backlight systems employed small fluorescent light emitters that emit white light but more recently light-emitting diodes have provided an efficient alternative. Moreover, light-emitting diodes can produce relatively narrow-bandwidth colored light that is more efficiently transmitted through the color filters employed with light valve displays such as liquid crystal displays. In other embodiments, light-valve displays can be used with a color-sequential control scheme that renders color filters unnecessary. U.S. Patent Application Publication No. 20120320566, describes a liquid crystal display device and LED backlight system. EP 2078978 A3 discloses an LCD backlight containing an LED with adapted light emission and suitable color filters.

Backlit display systems typically suffer from reduced contrast ratio due to light leakage through the light valves and the limited on/off optical ratio imposed by light valves, especially the popular liquid crystal displays. To some extent, this problem can be mitigated with localized dimming. Localized dimming is accomplished by analyzing a display image, determining areas of light and dark in the image, and controlling light emitters in the corresponding area of the backlight to emit light in amounts corresponding to the luminance of the image areas. Localized dimming can be done separately for each color of light independently controlled in a backlight. Since light emitting diodes located in different areas of a backlight and that emit different colors of light can be separately controlled, backlights using light emitting-diode arrays can provide improved optical efficiency and contrast in a light-valve display. U.S. Pat. No. 8,581,827 entitled Backlight system and liquid crystal display having the same discloses a pulse width modulation control circuit to providing different brightness levels for adjacent rows of light emitters in a backlight.

However, light-emitting diodes are typically large, thereby increasing the thickness of a display and limiting the number of light emitters in a display area, and often are relatively less efficient at different brightness levels. For example, a direct-lit LED backlight unit for a high-definition display can have several hundred light-emitting elements and exhibit considerable blooming around bright spots in an image. Backlights using light-emitting diodes therefore limit display thinness and flexibility, are less efficient than is desired, and limit the extent to which local dimming can improve display contrast. Moreover, manufacturing processes for backlight systems using light-emitting diodes are relatively inefficient, requiring the placement of individual light emitters.

There remains a need, therefore, for a backlight having reduced thickness, improved electrical efficiency, improved display contrast, and improved manufacturing efficiency.

SUMMARY OF THE INVENTION

The present invention provides a backlight system having a plurality of bare die light emitters with contact pads on a light-emitter substrate electrically connected to backplane conductors on or in a backplane substrate, forming a backlight. A plurality of light valves is disposed to receive light from the light emitters and the number of light valves is greater than the number of light emitters. In one embodiment, the bare die are directly mounted on or adhered to the backplane substrate and electrically connected to electrical conductors on the backplane substrate. In another embodiment, the bare die are mounted on or adhered to one or more compound structure substrates and electrically connected to electrical conductors on the compound structure substrates. The compound system substrates are mounted on or adhered to the backplane.

By using bare die on the backplane or on compound structure substrates, the uniformity of light output from the light emitters and the density and resolution of the light emitters in the backlight are increased, enabling improved image quality and local dimming for a display, for example a display using light valves to form images. The bare die can be very small, for example having dimensions less than 20 microns, and difficult to handle using conventional integrated circuit handling tools. In an embodiment of the present invention, the bare die are disposed on the backplane or compound structure substrates using micro-transfer printing. The light emitters can be inorganic light-emitting diodes (LEDs) such as micro-light-emitting diodes. The light emitters can emit white light or different light emitters can emit different colors of light, for example red, green, and blue light. The different light emitters emitting different colors of light can be independently controlled and arranged in groups spatially associated with portions of the light valves to provide local dimming in coordination with a display controller controlling the light valves and providing image analysis.

In certain embodiments, the contact pads can be on the same side of the light-emitter substrate or on opposite sides.

In certain embodiments, the light emitters are disposed between the backplane and the light valves and the backplane can be opaque. In another embodiment, the backplane is disposed between the light emitters and the light valves and the backplane is transparent or light diffusive or includes light diffusive layers or light diffusive layers are disposed on the backplane between the light emitters and the light valves. The backplane can be white, light diffusive, or include multiple layers such as optical or thermal management layers.

In an embodiment, the light emitters are controlled through the backplane conductors using passive-matrix control. In further embodiments, chiplets are disposed on the backplane and electrically connected to the backplane conductors to provide active-matrix control of the light emitters. The chiplets, light emitters, or both chiplets and light emitters can be provided on a compound structure and can be provided in a surface-mount device.

In an embodiment, the light valves are spatially divided into portions spatially corresponding to portions of the light emitters in the backlight backplane and portions of a display image. The number of light valves in each portion is greater than the number of light emitters in the corresponding backplane portion. An image analysis device (e.g., provided in a display or backlight controller) determines a desired uniform backlight light output for each display image portion and controls each backlight portion to provide the desired light output. In one embodiment of the present invention, each light emitter is controlled to provide a desired light output luminance, for example by controlling the current through the light emitter at any one of a variety of current levels. In another embodiment, a constant current is provided to the light emitters when the light emitters are on and various luminance levels are provided by employing a temporal pulse width modulation to turn the light emitters on and off for time intervals whose length corresponds with the desired luminance level. In yet another embodiment, each portion of the backlight includes a plurality of light emitters that emit each color of light at a predetermined constant current. The number of light emitters in the portion that emit light of the desired color are turned on to provide the desired luminance for the portion. For example, if twice the luminance is desired for a portion, twice the number of light emitters in the portion are turned on at the predetermined constant current. A light diffuser diffuses the light emitted from each portion so that each portion has a substantially uniform luminance level corresponding to the number of light emitter in the portion of the backlight backplane that is turned on.

In certain embodiments, a display of the present invention includes at least 500,000, one million, two million, 4 million, 6 million, 8 million, or 10 million light valves and at least 500, 600, 800, 1000, 1500, 2000, or 5000 light emitters.

In certain embodiments, a display of the present invention includes fewer than or equal to 4000, 2000, 1000, 500, 250, or 100 light valves per light emitter.

In an embodiment, a backlight unit is made by providing a backplane, disposing a plurality of bare die light emitters on the backplane, each light emitter having a light-emitter substrate and contact pads on the light-emitter substrate through which electrical current is supplied to cause the light emitter to emit light, and disposing a plurality of backplane conductors on the backplane for conducting control signals to control the light emitters through the contact pads. The light emitters can be disposed by micro-transfer printing the light emitters onto the backplane or micro-transfer printing the light emitters onto a compound structure substrate and disposing the compound structure substrate on to the backplane. In a further embodiment, a display is made by disposing a plurality of light valves to receive light from the light emitters of the backlight unit. The number of light valves is greater than the number of light emitters.

In embodiments of the present invention, the light emitters are micro-light-emitting diodes (micro-LEDs) and each micro-LED has a width from 2 to 5 μm, 5 to 10 μm, 10 to 20 μm, or 20 to 50 μm, each micro-LED has a length from 2 to 5 μm, 5 to 10 μm, 10 to 20 μm, or 20 to 50 μm, or each micro-LED has a height from 2 to 5 μm, 4 to 10 μm, 10 to 20 μm, or 20 to 50 μm. In other embodiments of the present invention, the backplane has a contiguous backplane substrate area that includes the micro-LEDs, each micro-LED has a light-emissive area, and the combined light-emissive areas of the micro-LEDs is less than or equal to one-quarter of the contiguous backplane substrate area or the combined light-emissive areas of the micro-LEDs is less than or equal to one eighth, one tenth, one twentieth, one fiftieth, one hundredth, one five-hundredth, one thousandth, one two-thousandth, or one ten-thousandth of the contiguous backplane substrate area. In further embodiments, the light emitters are micro-light-emitting diodes (micro-LEDs) and each micro-LED has an anode and a cathode disposed on a same side of the respective micro-LED and, optionally, the anode and cathode of a respective light emitter are horizontally separated by a horizontal distance. The horizontal distance can be from 100 nm to 500 nm, 500 nm to 1 micron, 1 micron to 20 microns, 20 microns to 50 microns, or 50 microns to 100 microns.

The present invention provides a backlight system having improved light uniformity, reduced power usage, and enables improved manufacturing efficiency.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1A:
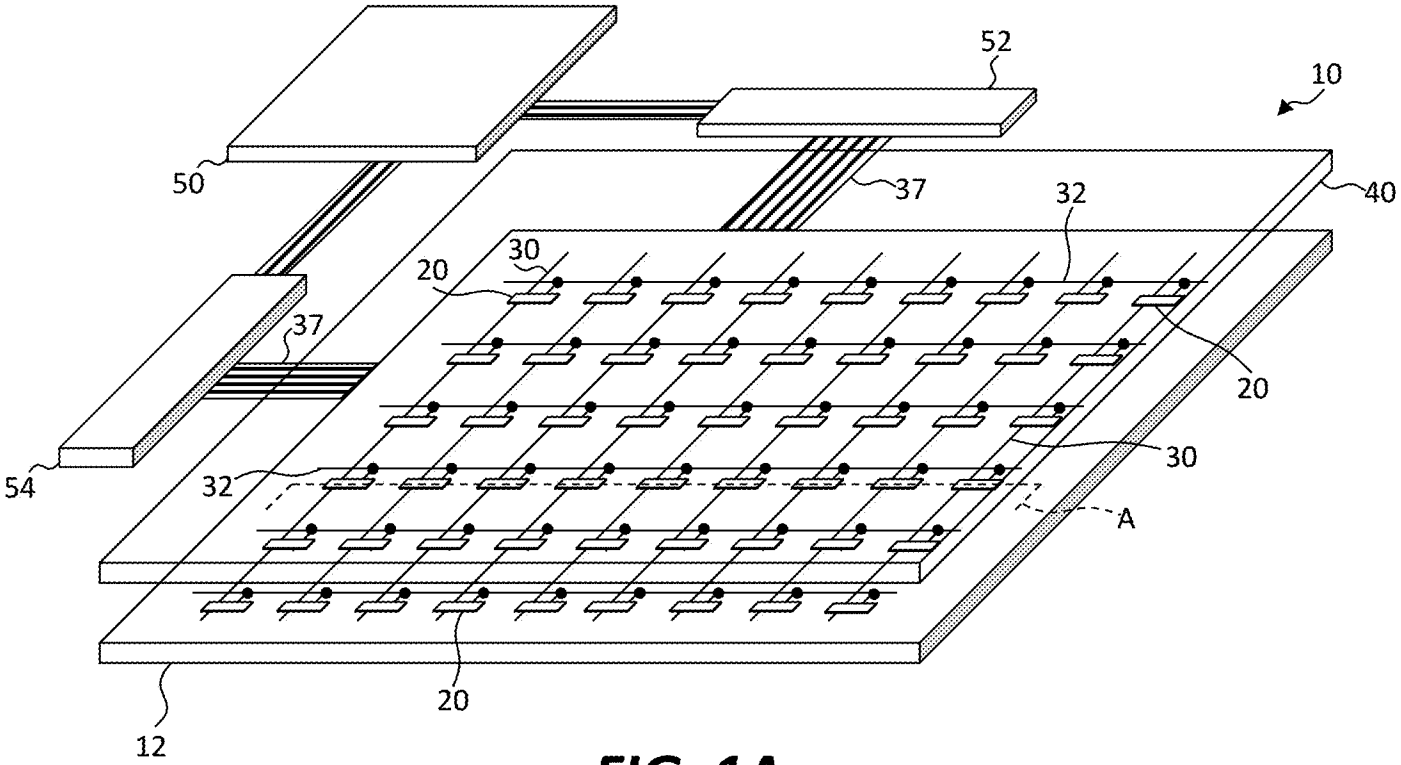
FIG. 1A is a perspective of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Figure 1B:
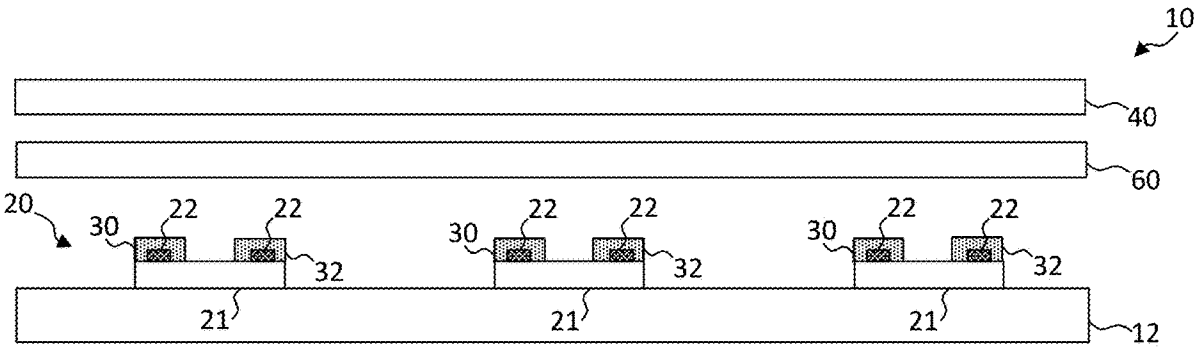
FIG. 1B is a cross section of the embodiment of FIG. 1A taken along the cross section line A.
Figure 1C:
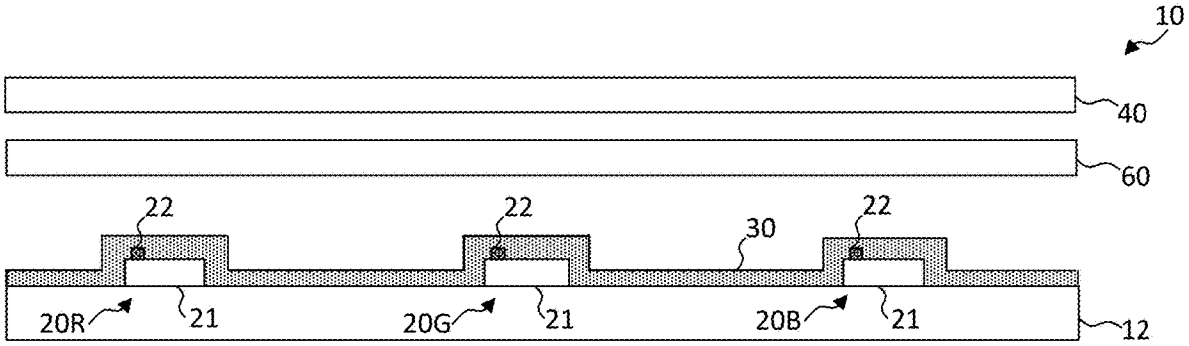
FIG. 1C is a cross section of the embodiment of FIG. 1A taken orthogonal to the cross section line A along a backplane conductor.
Figure 1D:
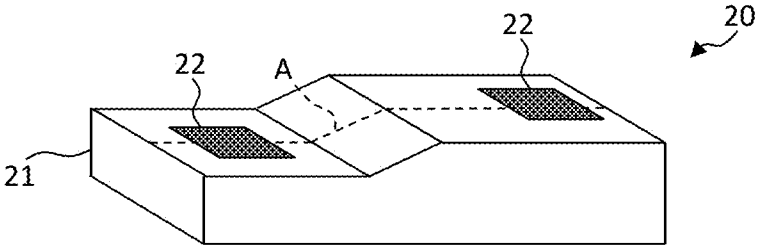
FIGS. 1D and 1E are perspectives of light emitters according to embodiments of the present invention.
Figure 1E:
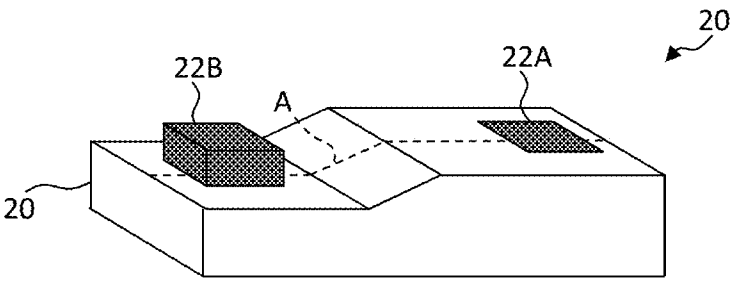

Referring to the perspectives of FIGS. 1A, 1D, and 1E and the cross sections of FIGS. 1B and 1C, in an embodiment of the present invention, a backlight system 10 includes a backplane 12 and a plurality of bare die light emitters 20 disposed over or on the backplane 12 or on or in layers on the backplane 12. Each light emitter 20 has a light-emitter substrate 21 and first and second light-emitter electrical contact pads 22 on the light-emitter substrate 21 through which electrical current is supplied to the light emitter 20 to cause the light emitter 20 to emit light (FIG. 1B). As shown in FIG. 1A, a plurality of first and second backplane conductors 30, 32 are disposed on the backplane 12 for conducting control signals to control the light emitters 20. A plurality of light valves 40 (shown as a light-valve layer 40) are disposed to receive light from the light emitters 20. In certain embodiments, the number of light valves 40 is greater than the number of light emitters 20.

As shown in FIG. 1A, the first backplane conductors 30 can be column-data lines connected by a bus 37 to a backlight column controller 52. The second backplane conductors 32 can be row-select lines connected by a bus 37 to a backlight row controller 54. The backlight row controller 54 and the backlight column controller 52 can be a part of a backlight, system, or display controller 50 or connected to a backlight, system, or display controller 50. In an embodiment, the column, row, and backlight controllers 52, 54, 50 can control the light emitters 20 using a passive-matrix control method. In another embodiment, an active-matrix control method is used.

The row controller 54, the column controller 52, and the backlight controller 50 can be, for example integrated circuits, digital computers, controllers, or state machines. The backplane 12 can be a substrate such as a display substrate or printed circuit board, and can include, for example, glass, metal, plastic, resin, polymer, or epoxy, and can be rigid or flexible. In various embodiments, the first and second backplane conductors 30, 32 are wire traces, such as copper or aluminum traces, or other conductive wires including cured conductive inks, and are made through photolithography, etching, stamping, or inkjet deposition.

The first and second contact pads 22 are electrically conductive electrical connection portions of the light emitter 20, for example an electrically conductive portion of a material such as a metal (e.g., aluminum, tungsten, titanium, tantalum, silver, tin, or gold) or a doped or undoped semiconductor material such as silicon or polysilicon on or in the light-emitter substrate 21 or on or in a layer on the light-emitter substrate 21. The first and second contact pads 22 can be portions or areas of a patterned layer and are connected to light-emitting materials in the light emitter 20 by electrical conductors or conductive materials, for example a metal or a doped semiconductor layer or patterned conductive layer. The light emitter 20 can include patterned dielectric layers to prevent electrical shorts between elements of the light emitter 20.

The light valves 40 can be, for example, liquid crystals or micro-electro-mechanical system structures (MEMS) devices and can be controlled by circuits on a display backplane, for example a thin-film transistor flat-panel backplane. Each light valve 40 can control a sub-pixel in a display and allows light to pass through the light valve 40 when the valve is in an open or transmissive state and prevents light from passing through when the valve is in a closed or opaque state. Some light valves 40 can have intermediate states that allow some light to pass through, thus providing a gray scale capability for the sub-pixel. There are more light valves 40 than light emitters 20 and the light valves 40 can be disposed in groups of multiple light valves 40 spatially associated with one or more light emitters 20, where each group of light-valves has more light valves 40 than associated light emitters 20.

The light emitters 20 can be light-emitting diodes, for example organic or inorganic light-emitting diodes, and can be micro-light-emitting diodes suitable for micro-transfer printing. The light emitters 20 are bare die light emitters 20 and have a light-emitter substrate 21 that is separate and distinct from and independent of the backplane 12. For example, the light emitters 20 can have a semiconductor or compound semiconductor light-emitter substrate 21 and the backplane 12 can be a glass, polymer, or epoxy substrate. In contrast to a packaged light emitter, according to embodiments of the present invention the light emitters 20 are bare die and the light emitter 20 contact pads 22 are directly connected to electrical conductors formed on or in the substrate on which the light emitter 20 is mounted or adhered. In one embodiment, the substrate on which the light emitters 20 are mounted or adhered is the backplane 12 and the first and second contact pads 22 are directly connected to the first and second backplane conductors 30, 32, for example with photolithographically defined electrical conductors, with solder joints, or with wire bonds. In another embodiment, the substrate on which the light emitters 20 are mounted or adhered is a compound structure substrate on which multiple light emitters 20 or controller chiplets are mounted or adhered, the first and second contact pads 22 are directly connected to conductors 16 on the compound structure substrate, and the conductors 16 on the compound structure substrate are electrically connected to the first and second backplane conductors 30, 32, as described further below. Thus, a bare die light emitter 20 of the present invention is unpackaged and does not have an encapsulating structure such as a dual-inline package or chip carrier for example with a cavity for holding the light emitter and interposing electrical connectors such as pins or encapsulating structure pads. A bare die integrated circuit or light emitter can be contacted directly by handling equipment when disposing the integrated circuit on a substrate. In contrast, handling equipment contacts the package of a packaged integrated circuit when disposing the integrated circuit on a substrate.

Backlight units having an increased number, resolution, or density of light emitters can provide improved uniformity of light emission and reduced power use by enabling more and smaller local dimming areas in the back light. However, very small light emitters, such as micro-light-emitting diodes, are not easily handled, packaged, or provided on a backlight substrate. Thus, in an embodiment the present invention provides an increased number, resolution, or density of light emitters 20 on a substrate (e.g., backplane 12) by using micro-LEDs that are formed on a source substrate and micro-transfer printed to a backlight backplane 12 or other substrate, thereby improving the uniformity of light emission, increasing flexibility, and reducing power use by enabling more and smaller local dimming areas in the back light. For example, in various embodiments, the present invention includes more than or equal to 500, 600, 800, 1000, 1500, 2000, or 5000 backlight light emitting elements for displays having more than or equal to 500,000, one million, two million, 4 million, 6 million, 8 million, or 10 million light valves. Thus, in embodiments, the present invention has fewer than or equal to 4000, 2000, 1000, 500, 250, or 100 light valves per light emitter (e.g., from 100 to 250, 250 to 500, 500 to 1000, 1000 to 2000, or 2000 to 4000 light valves per light emitter).

FIG. 1B is a cross section taken along cross section line A of FIG. 1A. As shown in FIG. 1B, a plurality of light emitters 20 are disposed on the backplane 12. Each light emitter 20 includes first and second contact pads 22. The first and second contact pads 22 are electrically connected to the first and second backplane conductors 30, 32, for example with wires formed by photolithography, screen printing, or inkjet printing curable conductive ink. FIG. 1C is a cross section of FIG. 1A in a direction orthogonal to cross section line A and along the length of first backplane conductor 30.

The light emitters 20 can all emit light of the same color such as white, for example as shown in FIG. 1B or different light emitters 20 can emit different colors of light, for example as shown in FIG. 1C. Red light emitter 20R can emit red light, green light emitter 20G can emit green light, and blue light emitter 20B can emit blue light. Thus, in an embodiment of the present the light emitters 20 include first light emitters (e.g., 20R) that emit light of a first color (e.g. red) and second light emitters (e.g., 20G) that emit light of a second color (e.g., green) different from the first color. The light emitters 20 can include third light emitters (e.g., 20B) that emit light of a third color (e.g., blue) different from the first and second colors. Each color of light emitter 20 can be controlled independently of any other color of light emitter 20. FIGS. 1B and 1C also illustrate a light diffuser 60 located between the light emitters 20 and the light valves 40. Such a light diffuser increases the uniformity of the light that is transmitted to the light valves 40. The white point of the backlight can be adjusted by adjusting the amount of light emitted from one or more of each of the different colors of light emitters 20.

In the more detailed light emitter 20 perspectives of FIGS. 1D and 1E with the cross section line A indicated, the light-emitter substrate 21 of the light emitter 20 has a relatively thicker portion with a first contact pad 22A and a relatively thinner portion with a second contact pad 22B. As shown in FIG. 1E, the second contact pad 22B of the relatively thinner portion of the light emitter-substrate 21 is a compensating thicker contact pad 22B so that the light emitter 20 can be printed flat onto a substrate such as backplane 12 with the contact pads 22 on a side of the light emitter 20 adjacent to the backplane 12. In one embodiment, as shown, the first and second contact pads 22 are on a common side of the light emitters 20. In another embodiment of the present invention, the first and second contact pads 22 are located on opposite sides of the light emitter 20 (not shown). The light emitters 20 can emit light through the same side of the light emitter 20 as the contact pads 22 or the light emitters 20 can emit light through the side of the light emitter 20 opposite the contact pads 22.

Top- and bottom-emitting light emitter structures are described in commonly assigned U.S. patent application Ser. No. 14/788,632 entitled Inorganic Light-Emitting Diode with Encapsulating Reflector and in commonly assigned U.S. patent application Ser. No. 14/807,311 entitled Printable Inorganic Semiconductor Method, whose entire contents are incorporated herein by reference.

Figure 2:
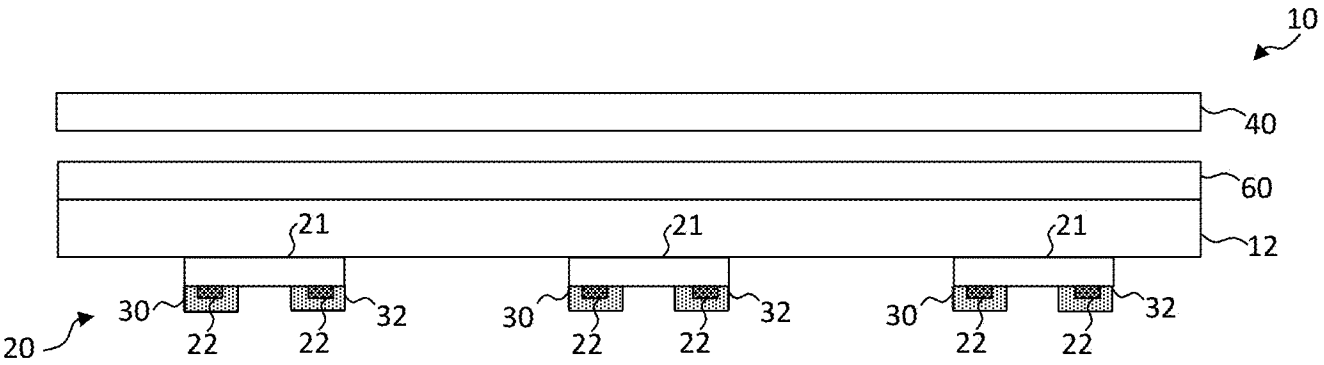
FIG. 2 is a cross section of an alternative embodiment of the present invention.

In an embodiment the light emitters 20 emit light in a direction away from the backplane 12 and the backplane 12 need not be transparent (i.e., a top-emitter configuration) for example as shown in FIGS. 1B and 1C. In such an embodiment, the light emitters 20 are disposed between the backplane 12 and the light valves 40. Alternatively, referring to FIG. 2, the light emitters 20 emit light through the backplane 12 and the backplane 12 is at least partially transparent to the light emitted by the light emitters 20 (i.e., a bottom-emitter configuration). In this embodiment, the backplane 12 is between the light emitters 20 and the light valves 40. As shown in FIG. 2, a light diffuser 60 is formed, coated, or disposed on the transparent backplane 12. In an alternative embodiment (not shown) the transparent backplane 12 is a light diffuser, for example including light-scattering particles.

Figure 3:
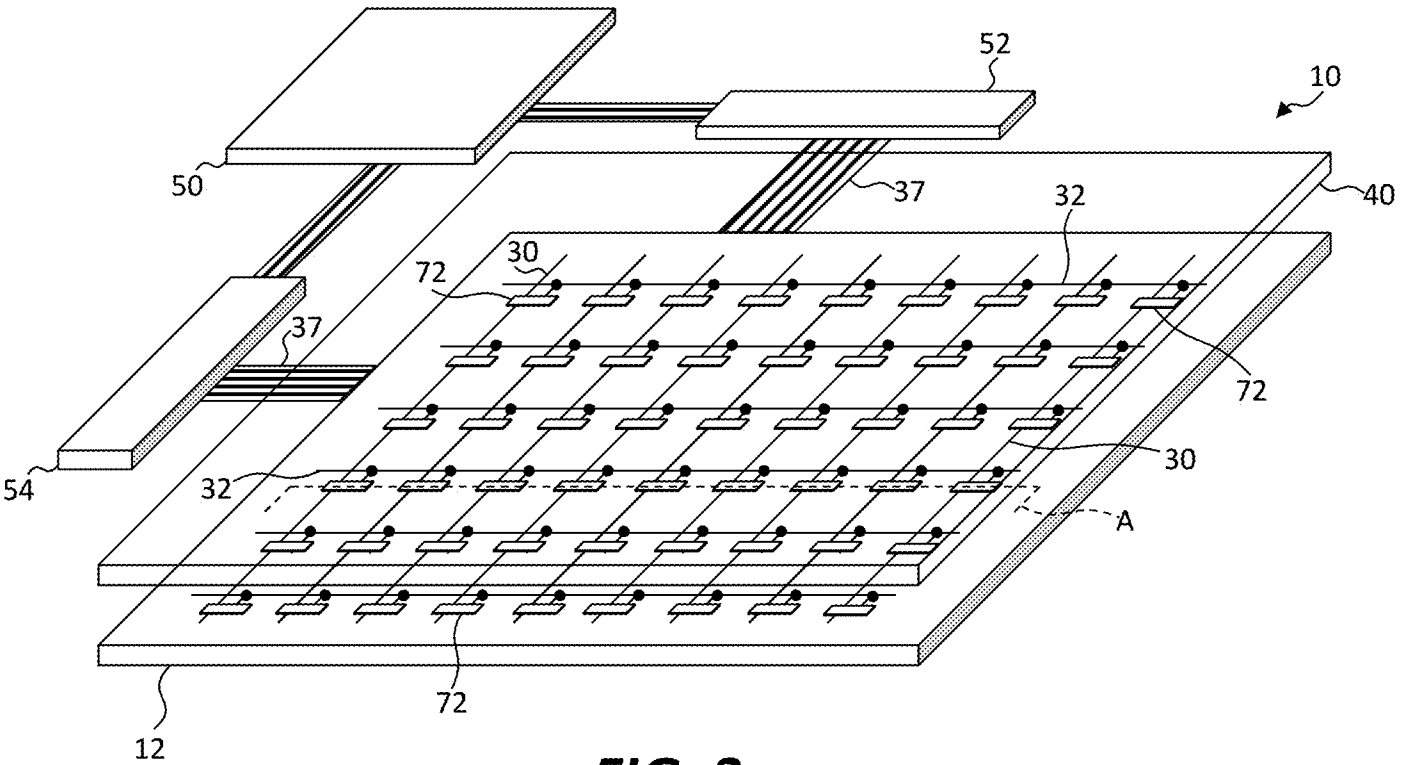
FIG. 3 is a perspective of another embodiment of the present invention having chiplet controllers.
Figure 4:
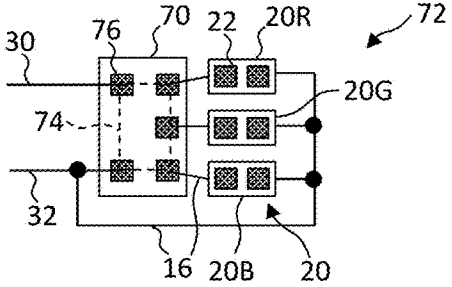
FIG. 4 is a schematic diagram including a chiplet and light emitters according to an embodiment of the present invention.

FIG. 3 is an alternative embodiment of the present invention having circuits 72 in place of the light emitters 20 of FIG. 1A. For example, and in contrast to FIG. 1A, the circuits 72 can be formed in a chiplet (e.g., a small integrated circuit that can be micro-transfer printed) to implement an active-matrix control method for the light emitters 20. In such an embodiment and also referring to FIG. 4, a backlight system 10 includes a plurality of chiplets 70 disposed on the backplane 12. Each chiplet 70 includes a chiplet circuit 74 electrically connected to at least one of the first and second contact pads 22 of the light emitters 20 to control one or more of the light emitters 20. The chiplet 70 can have chiplet contact pads 76 to facilitate electrical connections between the chiplet circuit 74 and light emitters 20 or external conductors, such as the first and second backplane conductors 30, 32, thereby electrically connecting the chiplets 70 to at least one of the light emitters 20 and one of the first and second backplane conductors 30, 32. Thus, the first and second backplane conductors 30, 32 disposed on the backplane 12 conduct control signals that control the light emitters 20 through the first and second contact pads 22 by way of the chiplet 70 and chiplet contact pads 76. As disclosed herein, the first and second backplane conductors 30, 32 conduct control signals that control the light emitters 20 through the first and second contact pads 22 when the first and second backplane conductors 30, 32 are connected to the chiplet circuit 74 of the chiplet 70 through chiplet contact pads 76 and the chiplet circuit 74 is connected to the first and second contact pads 22 of the light emitters 20 through other chiplet contact pads 76 of the chiplet 70. The circuit 72 can enable active-matrix control, improving backlight system 10 efficiency and reducing flicker. The circuit 72 can be enabled in a simple and efficient surface-mount structure that is readily disposed on a substrate using surface-mount tools.

Figure 5:
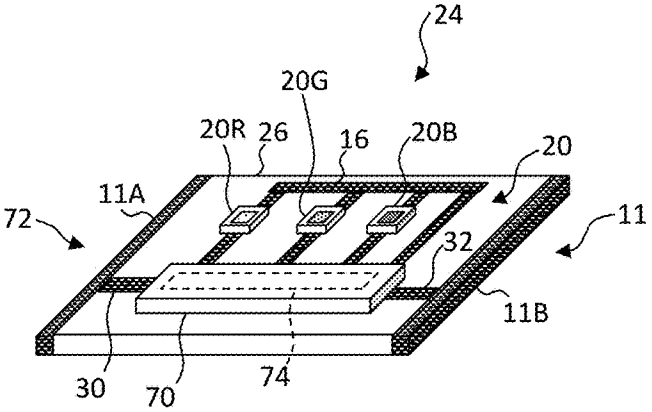
FIG. 5 is a perspective of an embodiment of the present invention including a surface mount device.

Referring to FIG. 5, the circuit 72 can be provided in a compound structure 24 on or in a compound structure substrate 26, for example a surface-mount substrate of a surface-mount device. The chiplet circuit 74 can be at least partially provided in a chiplet 70 and disposed on the compound structure substrate 26. The chiplet circuit 74 is electrically connected through chiplet contact pads 76 (FIG. 4) and electrical conductors 16 to red, green, and blue light emitters 20R, 20G, 20B and to the first and second backplane conductors 30, 32 through the terminals 11 (first terminal 11A and second terminal 11B). FIG. 5 illustrates a single full-color backlight light-emitting element, but in other embodiments additional light emitters 20 or chiplets 70 are included in the compound structure 24 and can provide multiple full-color light-emitting elements in the compound structure 24. Thus, in an embodiment, the compound structure 24 can include one or more chiplets 70 and a compound structure substrate 26 wherein at least one chiplet 70 and one or more light emitters 20 are disposed on the compound structure substrate 26. The at least one chiplet 70 is electrically connected to the one or more light emitters 20 with electrical conductors 16. Two or more contact pads 22 are electrically connected to the at least one chiplet 70 and the compound structure substrate 26 is mounted on or adhered to the backplane 12 (FIG. 3).

The backplane 12 can be a glass, metal, ceramic, polymer, or epoxy substrate or any suitable substrate having a side on which components and conductors can be disposed or processed. The backplane 12 can be a printed circuit board or a display substrate. Similarly, the compound structure substrate 26 can be a glass, metal, ceramic, polymer, or epoxy substrate or any suitable substrate having a side on which components and conductors can be disposed or processed. The compound structure 24 can have pins or connectors to electrically connect to the first and second backplane conductors 30, 32.

The backplane 12 or compound structure substrate 26 can be at least partially transparent or opaque to the light emitted by the light emitters 20 depending in part on the disposition of the light emitters 20. In one top-emitter configuration, the light emitters 20 are disposed on the compound structure substrate 26 with the light emitters 20 between the light valves 40 and both the backplane 12 and the compound structure substrate 26 and both the backplane 12 and the compound structure substrate 26 can be opaque. In another top-emitter configuration, the light emitters 20 are disposed on the compound structure substrate 26 with the light emitters 20 between the light valves 40 and the compound structure substrate 26 and between the compound structure substrate 26 and the backplane 12. In this case, the compound structure substrate 26 can be opaque and the backplane 12 is at least partially transparent to the light emitted by the light emitters 20. In one bottom-emitter configuration, the light emitters 20 are disposed on the compound structure substrate 26 with both the backplane 12 and the compound structure substrate 26 between the light emitters 20 and the light valves 40 and both the backplane 12 and the compound structure substrate 26 are at least partially transparent to the light emitted by the light emitters 20. In another bottom-emitter configuration, the light emitters 20 are disposed on the compound structure substrate 26 with the light emitters 20 between the light valves 40 and the compound structure substrate 26 and the light emitters 20 are between the compound structure substrate 26 and the backplane 12. In this case, the compound structure substrate 26 is at least partially transparent to the light emitted by the light emitters 20 and the backplane 12 can be opaque.

The backplane 12 or the compound substrate 26 can be light diffusive or have a light diffuser coating or layer (e.g. as in FIG. 2). In other embodiments, backplane 12 or the compound substrate 26 is white, optically reflective, or optically diffusive. Such a backplane 12 can improve light uniformity and the efficiency of light emission.

Figure 6:
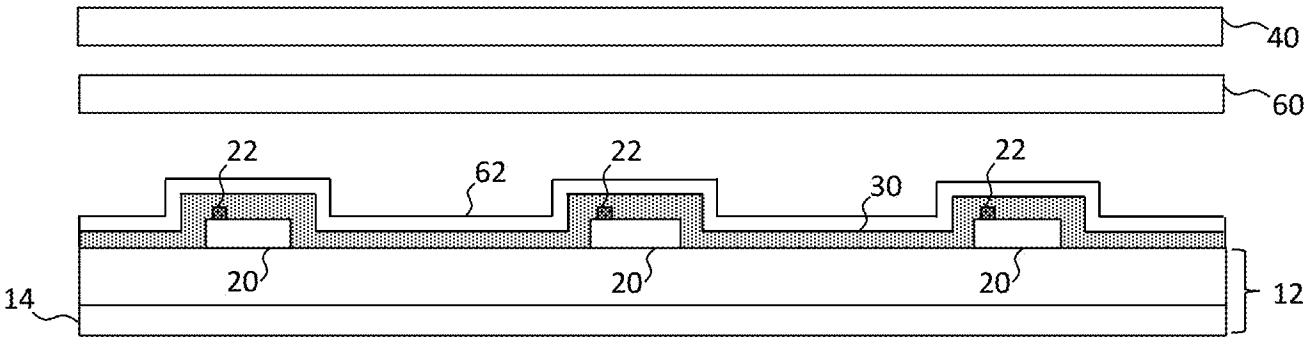
FIG. 6 is a cross section of an embodiment of the present invention having a light diffusive layer.

Referring to FIG. 6, in an embodiment a light diffusive layer 62 is coated on any one or more of the light emitters 20 (or chiplets 70, not shown). An additional light diffuser 60 can be included but is not always necessary. In general, and according to various embodiments of the present invention, a light diffuser can be disposed between the light emitters 20 and the light valves 40 or a diffusive layer (e.g. light diffusive layer 62 or 60) disposed on or in contact with any one or more of the light emitters 20, the conductors 16, or the first or second backplane conductors 30, 32. The backplane 12 can have multiple layers and one of the layers 14 can be more thermally conductive than another layer. The more thermally conductive layer 14 can be a metal layer. The thermally conductive layer 14 assists in removing heat from the light emitters 20, thereby improving their lifetime and efficiency.

Figure 7A:
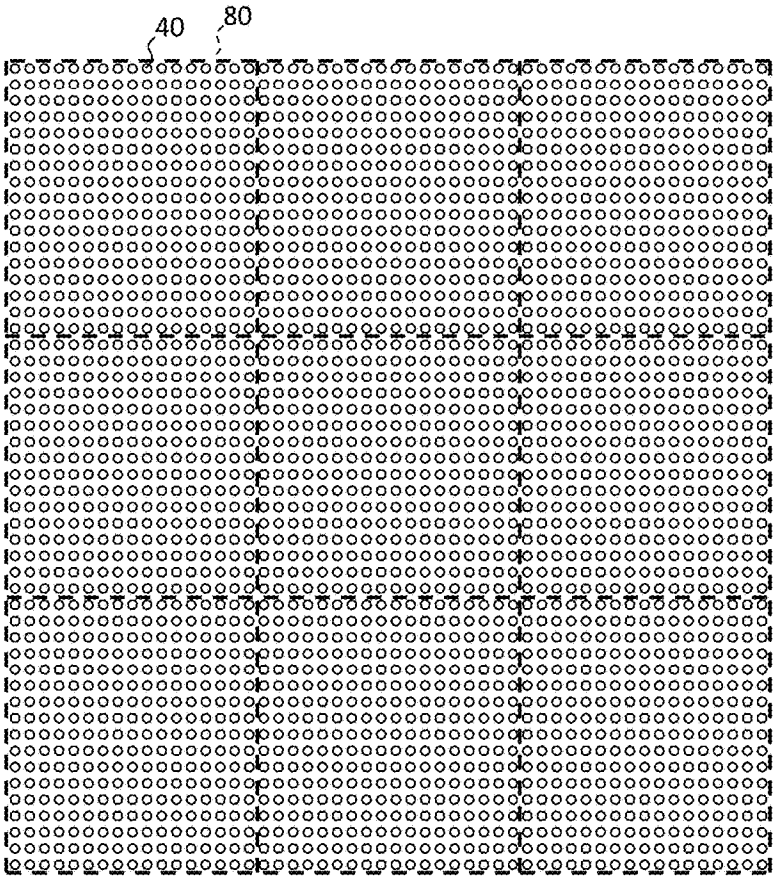
FIG. 7A is a plan view of the light valve layer of an embodiment of the present invention.
Figure 7B:
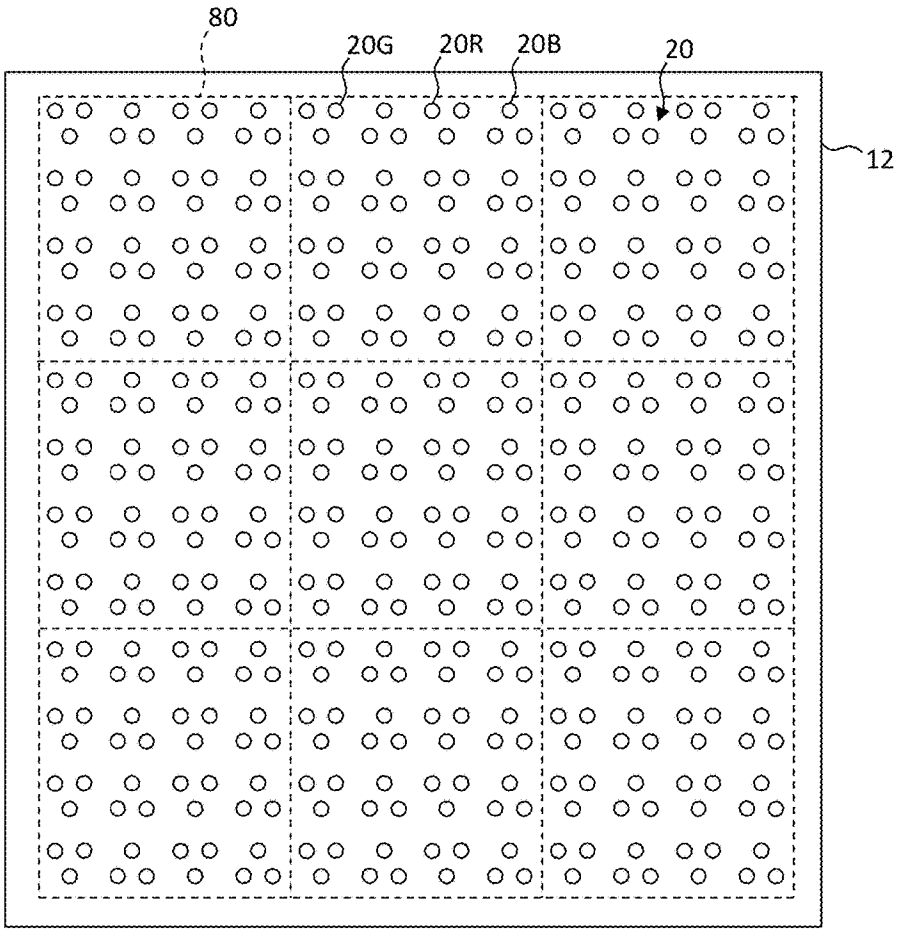
FIG. 7B is a plan view of the light-emitter layer of an embodiment of the present invention corresponding to FIG. 7A.

In an embodiment of the present invention, the system controller 50 (FIGS. 1A, 3) controls the light emitters 20 in coordination with the light valves 40 by analyzing an image for display with the light valves 40 and calculating a desired overall luminance level for portions of the image. The desired overall luminance level is provided to the light emitters 20 corresponding to that portion thereby providing local backplane light dimming to save power and to improve display contrast. Referring to FIGS. 7A and 7B, in an embodiment of the present invention, the light valves 40 and the backplane 12 each include corresponding and separate first and second portions 80. The portions 80 of the display image spatially correspond to portions 80 of the light valves 40 (FIG. 7A) and to portions 80 of the light emitters 20 (FIG. 7B). FIGS. 7A and 7B illustrate different layers of the backlight system 10 as shown in FIGS. 1A and 3. In FIG. 7A, an array of light valves 40 are spatially divided into separate portions 80. In an embodiment, the portions 80 do not overlap over the backplane 12. In FIG. 7B, an array of light emitters 20 are spatially divided into spatially corresponding separate portions 80. The light emitters 20 in a portion 80 are associated with, correspond to, and are controlled in combination with the light valves 40 in the same portion 80, for example by the display, system, or backlight controller 50.

In an embodiment, the system controller 50 controls the light emitters 20 so that all of the light emitters 20 in the first portion 80 are controlled to emit light at a first luminance and all of the light emitters 20 in the second portion 80 are controlled to emit light at a second luminance different from the first luminance. In an embodiment, both the first and second luminance are greater than zero; in another embodiment either the first luminance or the second luminance is zero.

Micro-light-emitting diodes can have a preferred current density at which the performance of the micro-light-emitting diodes is preferred, for example the micro-light-emitting diodes are the most efficient, have a desired luminance, or have a desired lifetime. Thus, in an embodiment the backlight controller 50 controls the light emitters 20 so that all of the light emitters 20 that emit light of a common color are driven with the same power to emit light of the common color.

In an embodiment of the present invention, a portion 80 of light emitters 20 includes more than one light emitter 20 that emits light of a common color. If the light emitted from a portion is adequately diffused, different luminance from a portion 80 can be accomplished by using different numbers of common-color light emitters 20 in the portion 80. For example, as illustrated in FIG. 7B, each portion 80 includes light emitters 20 that emit light of a common color. If each of the common-color light emitters (e.g., red light emitters 20) are driven with a constant current, optionally the same constant current, different luminance levels for the portion 80 can be achieved by providing power to different numbers of light emitters 20. In the example of FIG. 7B, sixteen different luminance levels other than zero can be enabled by providing current to a corresponding number of common-color light emitters 20. Each color of light emitter 20 in a portion 80 can be similarly controlled. Thus, in an embodiment of the present invention, the backplane 12 of the backlight system 10 includes a first portion 80 having two or more first light emitters 20 and a second portion 80 spatially separate from the first portion 80 having two or more second light emitters 20. The backlight controller 50 controls the first and second light emitters 20 so that the first portion 80 emits light of a first brightness greater than zero and the second portion 80 emits light of a second brightness greater than the first brightness by controlling at least one of the first light emitters 20 to emit no light.

In a further embodiment, the light emitters 20 within a portion 80 are controlled with pulse width modulation to provide different luminance levels over a display frame period. In a further embodiment, some light emitters 20 are controlled to emit light temporally out of phase with other, different light emitters 20, thereby reducing flicker.

In a further embodiment of the present invention, the light valves 40 display images that are spatially separated into portions 80 spatially corresponding to portions of the light emitters 20. Each portion 80 has one of a plurality of luminance levels greater than zero and has a maximum luminance. The backlight controller 50 controls the light emitters 20 in a portion 80 to emit light that is less than the maximum luminance by controlling at least one of the light emitters 20 in the portion 80 to emit no light.

In embodiments of the present invention, the light emitters 20 are micro-light-emitting diodes (micro-LEDs) and each micro-LED has a width from 2 to 5 μm, 5 to 10 μm, 10 to 20 μm, or 20 to 50 μm, each micro-LED has a length from 2 to 5 μm, 5 to 10 μm, 10 to 20 μm, or 20 to 50 μm, or each micro-LED has a height from 2 to 5 μm, 4 to 10 μm, 10 to 20 μm, or 20 to 50 μm. In other embodiments of the present invention, the backplane has a contiguous backplane substrate area that includes the micro-LEDs, each micro-LED has a light-emissive area, and the combined light-emissive areas of the micro-LEDs is less than or equal to one-quarter of the contiguous backplane substrate area or the combined light-emissive areas of the micro-LEDs is less than or equal to one eighth, one tenth, one twentieth, one fiftieth, one hundredth, one five-hundredth, one thousandth, one two-thousandth, or one ten-thousandth of the contiguous backplane substrate area. In further embodiments, the light emitters 20 are micro-light-emitting diodes (micro-LEDs) and each micro-LED has an anode and a cathode disposed on a same side of the respective micro-LED and, optionally, the anode and cathode of a respective light emitter 20 are horizontally separated by a horizontal distance. The horizontal distance can be from 100 nm to 500 nm, 500 nm to 1 micron, 1 micron to 20 microns, 20 microns to 50 microns, or 50 microns to 100 microns. In an embodiment, the micro-light-emitting diodes are surface-mount devices or are incorporated into surface-mount devices.

In operation, an image is provided to a display controller 50 and displayed on the light valves 40. At the same time, backplane row and column controllers 54, 52 provide control signals to the light emitters 20 on the backplane 12 to cause the light emitters 20 to emit light. In one embodiment, the light emitters 20 are controlled using passive-matrix control. In another embodiment, control circuits 72 provide storage and control of control signals so that the light emitters 20 are controlled using active-matrix control.

Figure 8:
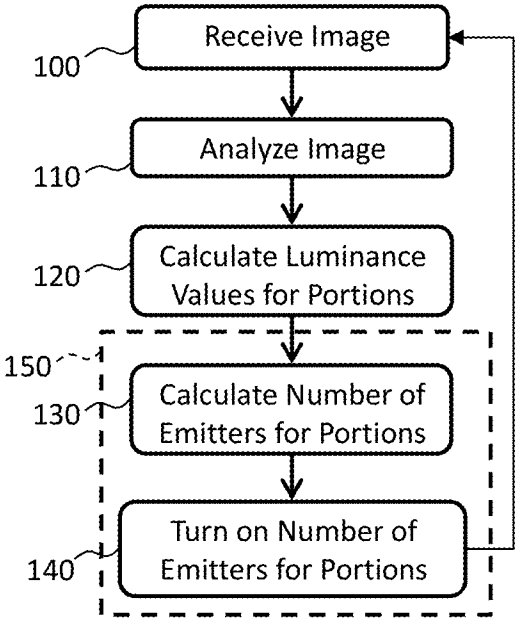
FIG. 8 is a flow diagram according to an embodiment of the present invention.

In a further embodiment and referring to FIG. 8, an image is received in step 100 and the display/backlight controller 50 analyzes the image in step 110 to calculate the desired backlight luminance for each portion 80 in step 120. In step 150, the light emitters 20 in each portion 80 are controlled to emit the desired luminance. In one embodiment, the control is provided by controlling the current that passes through the light emitters 20. In another embodiment, light emitters 20 in a portion are controlled with a constant current to emit light at a corresponding constant luminance and pulse width modulation is used to temporally control the average light emission, for example over a display frame time. In yet another embodiment, the number of light emitters 20 needed to provide the calculated luminance for each portion 80 is calculated in step 130 and in step 140 the number of light emitters 20 in each portion are controlled with a constant current to emit light at the corresponding constant luminance to provide the desired portion luminance. The light output from the light emitters 20 is maintained for a frame time and then a new image is received and the process repeats.

In various embodiments of the present invention, the compound structure substrate 26 can be flexible or rigid and can include glass, a polymer, a curable polymer, plastic, sapphire, silicon carbide, copper or diamond, or a high thermal conductivity material or any material that provides a suitable surface for disposing, making, or forming the elements of the compound structure 24. The compound structure substrate 26 can be or have layers that are light absorbing, black or impregnated with or include light-absorbing particles or pigments, such as carbon black or light-absorbing dyes. Such materials can be coated, for example by spray, curtain, or spin coating, cured with heat or electromagnetic radiation, and patterned using photolithographic methods.

The backplane 12 can be printed circuit boards, for example including glass, ceramic, epoxy, resin, or polymer, can be made in a layered structure with conductive traces as are known in the printed-circuit board industry, and can also have layers or coatings that are light absorbing, black or impregnated with or include light-absorbing particles or pigments, such as carbon black or light-absorbing dyes. The backplane 12 can be rigid or flexible. The compound structure substrate 26 can be connected to the backplane 12 with soldered connections, using surface mount structures and techniques, or using connectors and plugging the substrates into backplane connectors. The backlight system 10 can be flexible or rigid. The compound structures 24 can be daughter boards on the backplane 12. Alternatively, the compound structures 24 can be tiles mounted on, adhered to, or plugged into the backplane 12. Commonly assigned U.S. patent application Ser. No. 14/822,866 entitled Display Tile Structure and Tiled Display describes display tiles and structures and is hereby incorporated by reference in its entirety.

The electrical conductors 16 or first or second backplane conductors 30, 32 can be metal, for example aluminum, silver, gold, tantalum, tungsten, titanium, or include metals or metal alloys, conductive metal oxides, or conductive inks having conductive particles. Deposition and patterning methods, for example using evaporative coating and photolithography, or inkjet deposition and curing can be used to form the conductors 16 or first or second backplane conductors 30, 32. The same or different methods may be used to form the conductors 16 or first or second backplane conductors 30, 32.

Electrical connections to the compound structure substrate 26 from the backplane 12 can be metal interconnect structures, solder, solder balls, reflowed solder, anisotropic conductive film (ACF), metal pillars, pins (e.g., similar to integrated circuit pins), or connector pins (e.g., as used in the printed-circuit board industry).

In one embodiment of the present invention, the light emitters 20 are formed on a native semiconductor wafer (e.g., GaN) and then disposed on the backplane 12 or compound structure substrate 26 using micro transfer printing. For example, U.S. Pat. No. 8,722,458 entitled Optical Systems Fabricated by Printing-Based Assembly, which is incorporated herein by reference, teaches transferring light-emitting, light-sensing, or light-collecting semiconductor elements from a wafer substrate to a destination substrate. Additional details useful in understanding and performing aspects of the present invention are described in U.S. patent application Ser. No. 14/743,981, filed Jun. 18, 2015 and entitled Micro Assembled LED Displays and Lighting Elements, which is incorporated herein by reference. Furthermore, the structure of the backlight system 10 of the present invention can be formed using micro-transfer techniques, for example using a multi-step transfer or assembly process. By employing such a multi-step transfer or assembly process, increased yields are achieved and thus reduced costs. A discussion of compound micro-assembly structures and methods is provided in U.S. patent application Ser. No. 14/822,868 filed Aug. 10, 2015, entitled Compound Micro-Assembly Strategies and Devices, which is incorporated herein by reference. Furthermore, a redundancy scheme can be used to increase yield and/or compensate for faulty light emitters. Examples of redundancy schemes that can be used herein are described in U.S. patent application Ser. No. 14/743,981, filed Jun. 18, 2015 and entitled Micro Assembled LED Displays and Lighting Elements.

As is understood by those skilled in the art, the terms "over" and "under" are relative terms and can be interchanged in reference to different orientations of the layers, elements, and substrates included in the present invention. For example, a first layer on a second layer, in some implementations means a first layer directly on and in contact with a second layer. In other implementations a first layer on a second layer includes a first layer and a second layer with another layer therebetween.

Having described certain implementations of embodiments, it will now become apparent to one of skill in the art that other implementations incorporating the concepts of the disclosure may be used. Therefore, the invention should not be limited to the described embodiment, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

A cross section line
10 backlight system
11 terminals
11A first terminal
11B second terminal
12 backplane
14 thermally conductive layer
16 conductor
20 light emitter
20R red light emitter
20G green light emitter
20B blue light emitter
21 light-emitter substrate
22 contact pad
22A first contact pad
22B second contact pad
24 compound structure
26 compound structure substrate
30 column-data line/first backplane conductor
32 row-select line/second backplane conductor
37 bus
40 light valves/light valve layer
50 backlight controller/system controller/display controller
52 backlight column controller
54 backlight row controller
60 light diffuser
62 light diffusive layer
70 chiplet
72 circuit
74 chiplet circuit
76 chiplet contact pad
80 portion
100 receive image step
110 analyze image step
120 calculate luminance value for each portion step
130 calculate number of emitters for each portion step
140 turn on number of emitters for each portion step
150 emit light for each portion step

The invention claimed is:

1. A display having a display area, comprising:

a single backplane;

a plurality of bare die light emitters disposed on the backplane in a two-dimensional array within the display area, each light emitter comprising a light-emitter substrate and contact pads on the light-emitter substrate through which electrical current is supplied to cause the light emitter to emit light, wherein the light-emitter is a micro-LED that has been micro-transfer printed from a source substrate and has a width from 2 to 5 μm, 5 to 10 μm, 10 to 20 μm, or 20 to 50 μm;

a plurality of backplane conductors disposed on the backplane in the display area for conducting control signals to control the light emitters through electrodes formed on and in physical contact with the light emitters and in electrical contact with the contact pads; and a plurality of light valves disposed to receive light from the light emitters, wherein the number of light valves is greater than the number of light emitters, and wherein the backplane, light emitters, and backplane conductors form a single-backplane backlight for the plurality of light valves.

2. The display of claim 1, wherein the contact pads are on a common side of the light emitters.

3. The display of claim 1, wherein the light emitters are disposed between the backplane and the light valves or the backplane is between the light emitters and the light valves.

4. The display of claim 1, comprising a diffusive layer on one or more of the light emitters.

5. The display of claim 1, comprising:

a plurality of chiplets disposed on the backplane in the display area, each chiplet electrically connected to at least one of the contact pads to store a control signal and to control one or more of the light emitters responsive to the control signal, wherein each chiplet is electrically connected to at least one of the plurality of backplane conductors.

6. The display of claim 5, comprising a diffusive layer on at least one of the light emitters and chiplets.

7. The display of claim 1, wherein the backplane is one or more of white, optically reflective, and optically diffusive.

8. The display of claim 1, wherein the backplane has multiple layers and one of the layers in the backplane is more thermally conductive than another layer in the backplane.

9. The display of claim 8, wherein the more thermally conductive layer in the backplane is a metal layer.

10. The display of claim 1, comprising a diffuser disposed between the light emitters and the light valves or a diffusive layer disposed on or in contact with any one or more of the light emitters or the backplane conductors.

11. The display of claim 1, wherein the light emitters are micro-light-emitting diodes.

12. The display of claim 1, wherein the light emitters include first light emitters that emit light of a first color and second light emitters that emit light of a second color different from the first color.

13. The display of claim 1, comprising one or more chiplets and a compound structure having a compound structure substrate wherein at least one chiplet and one or more light emitters are disposed on the compound structure substrate, wherein the at least one chiplet is electrically connected to the one more light emitters with electrical conductors, two or more contact pads electrically connected to the at least one chiplet, and the compound structure substrate is mounted on or adhered to the backplane.

14. The display of claim 1, comprising a backlight controller that controls the light emitters so that all of the light emitters that emit light of a common color are driven with the same power to emit light of the common color.

15. The display of claim 14, wherein the backplane includes a first portion having two or more first light emitters and a second portion spatially separate from the first portion having two or more second light emitters and the backlight controller controls the first and second light emitters so that the first portion emits light of a first brightness greater than zero and the second portion emits light of a second brightness greater than the first brightness by controlling at least one of the first light emitters to emit no light.

16. The display of claim 14, wherein the backlight controller controls the light emitters using pulse width modulation and, optionally, at least one light emitter is controlled temporally out of phase with another, different light emitter.

17. The display of any one of claim 14, wherein the light valves display images that are spatially separated into portions corresponding to portions of the light emitters, each portion having one of a plurality of luminance levels greater than zero and including a maximum luminance, and comprising a backlight controller that controls the light emitters in a portion to emit light that is less than the maximum luminance by controlling at least one of the light emitters in the portion to emit no light.

18. The display of any one of claim 1, wherein the display includes at least 500,000 light valves and at least 500 light emitters.

19. The display of claim 1, wherein the display includes fewer than or equal to 4000 light valves per light emitter.

20. The display of claim 1, wherein the contact pads of the light emitter comprise a cathode and an anode that are separated by a horizontal distance, wherein the horizontal distance is in a range of 100 nm to 500 nm, 500 nm to 1 micron, 1 micron to 20 microns, 20 microns to 50 microns, or 50 microns to 100 microns.

21. A method of operating a display, the method comprising:

receiving an image having image portions corresponding to a display portion and a backlight portion:

analyzing the image to determine backlight luminance output values for each image portion;

calculating the number of light emitters needed to provide the determined backlight luminance for each portion; and turning on the number of calculated light emitters in each portion, wherein the display has a display area, and the display comprises:

a single backplane;

a plurality of bare die light emitters disposed on the backplane in a two-dimensional array within the display area, each light emitter comprising a light-emitter substrate and contact pads on the light-emitter substrate through which electrical current is supplied to cause the light emitter to emit light, wherein the light emitter is a micro-LED that has been micro-transfer printed from a source substrate and has a width from 2 to 5 μm, 5 to 10 μm, 10 to 20 μm, or 20 to 50 μm;

a plurality of backplane conductors disposed on the backplane in the display area for conducting control signals to control the light emitters through electrodes formed on and in physical contact with the light emitters and in electrical contact with the contact pads; and a plurality of light valves disposed to receive light from the light emitters, wherein the number of light valves is greater than the number of light emitters, and wherein the backplane, light emitters, and backplane conductors form a single-backplane backlight for the plurality of light valves.

22. The method of claim 21, wherein the contact pads of the light emitter comprise a cathode and an anode that are separated by a horizontal distance, wherein the horizontal distance is in a range of 100 nm to 500 nm, 500 nm to 1 micron, 1 micron to 20 microns, 20 microns to 50 microns, or 50 microns to 100 microns.

* * * * *